United States Patent [19]

Kitabatake

[11] 4,169,169

[45] Sep. 25, 1979

[54] TRANSFER PROCESS AND TRANSFER SHEET FOR USE THEREIN

[75] Inventor: Terumiti Kitabatake, Osaka, Japan

[73] Assignee: Dai Nippon Insatsu Kabushiki Kaisha, Tokyo, Japan

[21] Appl. No.: 808,879

[22] Filed: Jun. 22, 1977

[30] Foreign Application Priority Data

Jun. 23, 1976 [JP] Japan ..... 51-82634[U]

[51] Int. Cl.[2] ..... B41M 3/12; B41M 5/04

[52] U.S. Cl. ..... 427/149; 156/230; 156/236; 156/240; 427/261; 428/913; 428/914

[58] Field of Search ..... 428/913, 914; 427/146, 427/150, 151, 261, 149; 156/231, 234, 240, 236

[56] References Cited

U.S. PATENT DOCUMENTS

| | | | |
|---|---|---|---|
| 2,413,537 | 12/1946 | Aberbach | 428/203 X |
| 3,514,305 | 5/1970 | Taylor | 427/146 X |
| 3,898,357 | 8/1975 | Miller et al. | 428/914 X |
| 3,962,489 | 6/1976 | Ritzerfeld | 427/146 X |
| 4,027,345 | 6/1977 | Fujisawa et al. | 156/240 |
| 4,033,770 | 7/1977 | De Haes et al. | 156/234 X |

FOREIGN PATENT DOCUMENTS

| | | | |
|---|---|---|---|
| 862360 | 3/1961 | United Kingdom | 156/240 |

*Primary Examiner*—Thomas J. Herbert, Jr.
*Attorney, Agent, or Firm*—Koda and Androlia

[57] ABSTRACT

A transfer process comprises the steps of:

a. providing a transfer sheet comprising a substrate and a pattern layer comprising lower alcohol-soluble, water-insoluble dyes provided on at least one surface of the substrate;

b. wetting the pattern layer of the transfer sheet with a transfer solution containing lower alcohols and bringing the transfer sheet into close contact with a receiving surface onto which the pattern is to be transferred in such a manner that the pattern layer contacts the receiving surface;

c. maintaining the transfer sheet in close contact with the receiving surface under pressure; and d. peeling the transfer sheet from the receiving surface thereby to leave a transferred pattern corresponding to the pattern of the transfer sheet on the receiving surface.

This process uses a novel transfer sheet as one of its important features and permits easy formation of a transferred pattern which is beautiful and has excellent durability on a great variety of receiving surfaces including human skin and fiber materials. This process is particularly suitable as a simple body painting process.

9 Claims, 8 Drawing Figures

TRANSFER PROCESS AND TRANSFER SHEET FOR USE THEREIN

BACKGROUND OF THE INVENTION

The present invention relates to an exudation transfer process and a transfer sheet for use therein. More specifically, the invention is concerned with a transfer process which uses lower monohydric alcohols as a transfer agent, requires no use of heat and is applicable to the human body and with a new transfer sheet for use in the transfer process.

From ancient times, there has existed a strong desire among humans for decorating their skin or clothes, building materials for interior decoration, and other articles relating to daily life with ease and safety. For example, man has decorated his skin by tattooing, that is, injecting dyeing patterns directly into his skin by using a needle, by a hand-drawn picture comprising painting water-insoluble dyes, pigments, paints, colours and the like on the skin by means of a brush, or by decalcomania such as that used by a child. However, the former two methods cannot be easily practiced by an amateur, are expensive, are time-consuming and require a high level of technique. On the other hand, while the latter method can be simply practiced even by an infant, it results in a simultaneous transfer of a gelatin film layer onto the skin as in the conventional transfer processes hereinafter described and, thus, is very unnatural, and the resulting picture pattern is not fast.

On one hand, transfer methods for decorating such objects to be decorated as mentioned above which requires no special skill are known. These transfer processes can be broadly divided into water transfer, solvent transfer and heat transfer. Among them, the latter heat transfer can be further divided into heat sublimation transfer, thermoplastic transfer and heat melting transfer. These heat transfer processes all can reproduce the pattern to be transferred very naturally because they leave no film layer (gelatin etc.) other than coloring matter after transfer. However, they are inapplicable to human skin or other receiving materials having poor heat resistance because they use heat.

Then, a transfer paper using water or solvents is similar to the decalcomania. That is, as stated above, when the transfer paper is applied onto the skin, the film base such as a gelatin layer remains on the skin, and the transferred pattern exhibits an unnatural appearance, is seamed with the motion, expansion and contraction of the skin, thereby producing fine breaks in the film layer, and is accompanied by the risk of irritating and even inflaming the skin. In addition, when the transferred pattern is exposed to direct rays of the sun in summer, the polymerization or curing of the film by ultraviolet rays is promoted, and, as a result, the pattern may become difficult to remove.

The above described problems accompanying the prior art transfer processes are entailed also in the case of the objects other than human skin, such as fiber materials and wood materials to which the pictures are to be transferred. Further, as far as the heat transfer process is concerned, it has a disadvantage in that it does not provide a clear transfer pattern for materials other than polyester fibers.

SUMMARY OF THE INVENTION

It is a primary object of the present invention to provide a transfer process which is applicable with ease and safety to almost all objects including human skin, clothes, building materials, and the like, irrespective of the kinds of their materials.

It is another object of the present invention to provide a transfer process not requiring the use of heat.

Still another object of the present invention is to provide a transferred pattern which is relatively fast and provides little unnatural feeling to the skin.

A further object of the invention is to provide a transferred pattern which may be easily removed, if necessary.

An additional object of the invention is to provide a novel transfer sheet which can be used in the above stated transfer process.

The above objects of the present invention can be accomplished by the transfer process and the transfer sheet for use therein according to the present invention as hereinafter described.

The transfer process of the present invention comprises the steps of:

a. providing a transfer sheet comprising a substrate and a pattern layer containing lower alcohol-soluble, water-insoluble dyes in a desired pattern and provided on at least one surface of the substrate;
b. wetting the pattern layer of the transfer sheet with a transfer solution containing lower alcohols and bringing the transfer sheet into close contact with a receiving surface onto which said dyes are to be transferred in such a manner that the pattern layer contacts the surface to be transferred;
c. maintaining the transfer sheet in close contact with the receiving surface under pressure; and
d. peeling the transfer sheet from the receiving surface thereby to leave a transferred pattern corresponding to the pattern of the transfer sheet on the receiving surface.

The above stated objects and other objects of the present invention will be apparent from the following detailed description, drawings and examples.

DETAILED DESCRIPTION OF THE INVENTION

Figure 1:
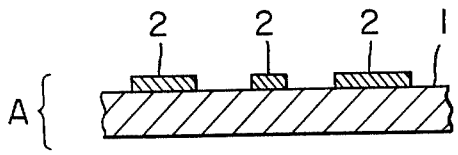
FIG. 1 is a partial cross-sectional view illustrating a basic construction of the transfer sheet of the present invention.

As is illustratively and notionally shown in the cross-sectional view of FIG. 1, the transfer sheet A of the present invention comprises a substrate 1 and a pattern layer 2 containing a particular dye or dyes provided on at least one surface of the substrate.

The substrate 1 constituting the transfer sheet of the present invention is one which is capable of forming a pattern layer of a specific composition and may be composed of, for example, various papers, plastic films or composite films thereof. Papers are preferably used particularly from the standpoints of printability, flexibility, processability and dryability. Among papers, a parchment paper having excellent ink removability is preferable. However, because a parchment paper has a drainability, when transfer is carried out, the transfer solution tends to exude along with a dissolved out ink outside from an image portion (a pattern portion) which may render the resulting pattern unclear and leave lightly colored portions other than the pattern portion. Therefore, if a blotting paper is used as a substrate in order to remove this defect, it is possible to permit the blotting paper to blot the transfer solution present on portions other than the pattern portion during transferring, thereby preventing extra exudation. Thus, the use of a blotting paper is very desirable. The thicker the blotting paper, the greater will the effect be. Ordinarily, a blotting paper having a basis weight of not less than 120 $g/m^2$ is satisfactory for this purpose. The blotting paper is not particularly critical with respect to quality and brand. Accordingly, conventional blotting papers for note-papers and experimental filter papers are satisfactory, and blotting papers having a basis weight of 120 $g/m^2$ and 150 $g/m^2$, respectively, such as those manufactured by the Inoue Paper Manufacturing Co., Japan, may be used.

The pattern layer constituting a part of the transfer sheet of the present invention can be produced by using an ink composition containing lower monohydric alcohol-soluble, water-insoluble dyes, for example, by means of a printing method such as silk screen printing, photogravure printing, offset printing and type printing or a hand writing method. A thickness of the pattern layer of the order of 10 microns is satisfactory when the transfer sheet is used only once. Increasing of the thickness of the pattern layer can produce a transfer sheet which can be repeatedly used. The thickness of the pattern layer is preferably in the range of about 20 to 50 microns.

Examples of dyes possessing the above described properties are oil dyes. In particular, taking into consideration the possibility of application to the skin, those oil dyes which are specified in the Health and Welfare Ministry Act. No. 30 of Japan and permitted to be admixed in medicines and cosmetics are particularly preferred. Examples of such oil dyes are red dyes such as 3-esoacetate of 9-o-carboxyphenyl-6-diethylamino-3-ethylimino-3-iso-xanthene(the legal name of this dye being Red No. 215, the general name being Rhodamine B Stearate), 2,4,5,7-tetrabromo-12,13,14,15-tetrachloro-3,6-fluorandiol (Red No. 218, Tetrachlorotetrabromofluorescein), 2,4,5,7-tetrabromo-3,6-fluorandiol (Red No. 223, Tetrabromofluorescein), 1-p-phenylazophenylazo-2-naphthol (Red No. 225, Sudan III), o-tolylazo-o-tolylazo-2-naphthol (Red No. 501, Medical Scarlet), 1-xylylazo-2-naphthol (Red No. 505, Oil Red XO), orange dyes such as 4,5-dibromo-3,6-fluorandiol (Orange No. 201, Dibromofluorescein), 1-o-tolylazo-2-naphthol (Orange No. 403, Orange SS), 4,5-diiodo-3,6-fluorandiol (Orange No. 206, Diiodofluorescein), yellow dyes such as 3,6-fluorandiol (Yellow No. 201, Fluorescein), 2-(2-quinolyl)-1,3-indandione (Yellow No. 204, Quinoline Yellow SS), 1-phenylazo-2-naphthylamine (Yellow No. 404, Yellow AB), 1-o-tolylazo-2-naphthylamine (Yellow No. 405, Yellow OB), green dyes such as 1,4-bis (p-toluino) anthraquinone (Green No. 202, Quinizarin Green SS), blue dyes such as 1-methylamino-4-o-tolylaminoanthraquinone (Blue No. 403, Sudan Blue B), and violet dyes such as 1-hydroxy-4-p-toluinoanthraquinone (Violet No. 201, Arizroll Purple SS).

The ink used in the production of the pattern layer of the present invention can have the same composition as conventional inks except for the above enumerated dyes. Therefore, the ink may include binders, plasticizers, solvents and other additives, as required.

Accordingly, the composition of the ink is not particularly limited. Ordinarily, the dye comprises 10 to 30% by weight (hereinafter expressed merely as %) of the total weight of the ink. More particularly, the red dye constitutes 10 to 25%, and the blue and yellow dye constitutes 13 to 30%, respectively. If the constituents other than the dyes are expressed as 100% in amount, it is desirable that binders constitute 20 to 30%, plasticizer 5 to 10% and solvents 60 to 75%.

The binders used in the present ink are cellulose derivatives or synthetic resins which can dissolve or at least swell and have a solubility equal to or smaller than that of the used dyes in lower monohydric alcohols, particularly ethyl alcohol under transferring conditions. A binder having excessive solubility results in the transfer of nonuniform filmy materials on the surface to be printed, which inhibits the transfer of a clear pattern. Examples of the binder are cellulose ethers, cellulose esters, partially saponified polyvinyl acetate and polyvinyl acetal. Particularly, such harmless binders as are used for packaging food stuffs, for example, ethyl cellulose, methyl cellulose and carboxymethyl cellulose are suitable for use. Among these, ethyl cellulose is most suitable.

The plasticizer used in the ink of the present invention is any of the conventional plasticizers including phthalic acid esters, terephthalic acid esters and oxyacid esters such as phosphoric acid esters. However, among these, the harmless plasticizers which are used for packaging food stuffs, for example, citric acid esters, are particularly preferable.

The solvent used in the ink of the present invention is any organic solvent capable of dissolving the above enumerated dyes, binders and plasticizers, such as, for example, aromatic hydrocarbons such as toluol and xylol. That is, the above set forth consituents may also be dispersed in water.

The solvent also has the effect of promoting drying at the time of printing. It is vaporized by natural drying or forced drying after printing and even if it is itself harmful, it has no harmful effect on the skin after transfer.

The pattern layer thus obtained after the application of an ink and the vaporization of the solvent ordinarily comprises 30 to 40% of a dye, 45 to 55% of a binder and 10 to 20% of a plasticizer.

The transfer process of the present invention using the transfer sheet obtained in the above described manner will now be described with reference to FIGS. 2 through 6 showing a preferred embodiment thereof.

Figure 2:
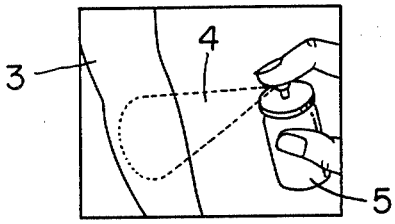
FIGS. 2 through 6 are diagrammatic perspective views illustrating respective steps in the transfer process of the present invention.

First, as is shown in FIG. 2, a transfer solution 4 is amply applied on the receiving surface 3 onto which the dye pattern is to be transferred (in this case, an arm of a person) by means of a spray 5, a brush or an impregnated cotton wad.

As the transfer solution, a lower monohydric alcohol having a boiling point not greater than 100° C. such as methyl alcohol, ethyl alcohol or isopropyl alcohol is used. Particularly suitable is ethyl alcohol, which is harmless to the human body and has appropriate vaporizability. Denaturated alcohols consisting of a mixture of ethyl alcohol and up to 5% of a denaturant such as geraniol, 8-acetylated sugar, phenylbrucine, linalool and diethyl phthalate, all of which are allowed to be used in cosmetics are also suitable. However, a transfer solution comprising 3 to 7%, based on the transfer solution, of resins and, if necessary, 0.1 to 0.6% of skin chapping inhibitors together with such an alcohol as mentioned above, is more preferable for use for the reasons hereinafter set forth.

Figure 3:
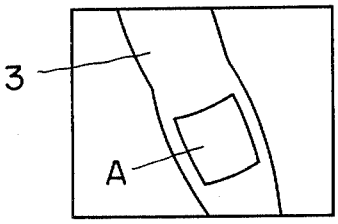
Figure 4:
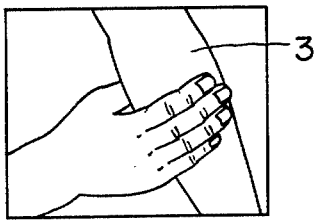
Figure 5:
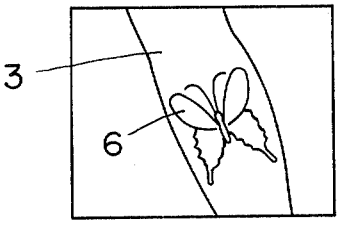

As is shown in FIG. 3, a transfer sheet A is then placed in close contact with the receiving surface before the transfer solution has dried in such a manner that the pattern layer contacts the receiving surface. Then, pressure is applied on the sheet A by pressing down the sheet lightly with a hand or finger and the sheet is maintained under this condition for about 2 seconds or longer, preferably 5 to 10 seconds (FIG. 4). When the transfer solution has partly dried after a specific period of time, the transfer sheet is peeled from the receiving surface. Thus, a transferred pattern 6 corresponding to the pattern of the transfer sheet is obtained on the receiving surface (FIG. 5).

The above-described example illustrates a transfer process in which the receiving surface is first wetted with the transfer solution, and the transfer sheet is placed in close contact with the wetted receiving surface, the wetting of the transfer sheet and the close contact thereof with the receiving surface being simultaneously carried out (FIGS. 2 to 3). However, a transfer process in which the transfer solution is first applied on the pattern layer of the transfer sheet to wet the pattern layer, and the resulting transfer sheet is then placed in close contact with the receiving surface may also be used. When the receiving surface is made of a hygroscopic fiber material or a wood material, the latter process can provide a clearer transfer effect.

Figure 6:
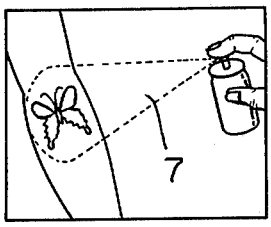

The transferred pattern thus obtained is highly resistant to fading or discoloration even if it is contacted by ordinary moisture or immersed in water or sea water, provided that the dye used is water-insoluble. Furthermore, the transferred pattern exhibits considerable resistance to abrasion. In addition, even if the receiving surface is made of cloth, the transferred pattern exhibits considerable resistance to laundering other than rubbing washing. However, in order to increase this resistance to water or rubbing, a protecting solution 7 of a resin, preferably an alcohol-soluble resin, in an appropriate solvent may be applied on the transferred pattern by any method, and the solvent may then be vaporized to form a resin film on the transferred pattern (FIG. 6).

Figure 7:
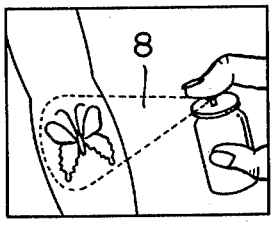
FIGS. 7 and 8 are diagrammatic perspective views illustrating the processes of removing a transferred pattern.
Figure 8:
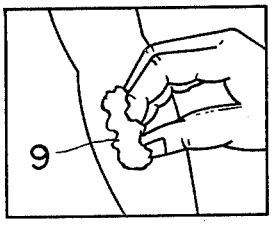

If the transferred pattern is to be removed from the receiving surface, a removing solution 8 comprising mainly the lower alcohols mentioned above is applied onto the transferred pattern by any method (FIG. 7), and the solution is wiped off with cotton wad or cloth. In this manner, the transferred pattern is completely removed (FIG. 8).

As described above, the transfer process of the present invention is carried out by using a transfer sheet and three solutions, namely, a transfer solution, a protecting solution and removing solution. However, it is undesirable to use the transfer solution, protecting solution and removing solution separately in a decorative process for the purpose of pleasure, such as body painting, because such a procedure is troublesome. In this respect, I have found that the transfer solution having the above stated composition, i.e., containing 3 to 7% by weight of the resin and the balance of the above mentioned lower monohydric alcohol, also functions effectively as both a protecting solution and a removing solution. Further, when the transfer solution contains a resin, an undercoating film is formed under the transferred pattern. This film exhibits an anchoring effect for the receiving surface and, at the same time, shields off greasy sweat thereby to protect the dye of the transferred pattern when the receiving surface is the skin, whereby the fastness of the transferred pattern is enhanced.

The resins to be included in the transfer solution are those which are soluble in the aforementioned lower monohydric alcohols and insoluble or scarcely soluble in water. Examples of such resins are polyvinyl acetals such as polyvinyl acetal and polyvinyl butyral and alkyl celluloses such as highly-substituted methyl cellulose and ethyl cellulose (the degree of substitution being greater than about 2). Among these, polyvinyl butyral is most suitable for use.

The transfer solution can be prepared by dissolving the resin in the alcohol in quantities such as to provide a resin concentration of 3 to 7% therein. The resin concentration is critical in the present invention. In the case where the resin concentration is less than 3%, a resin film having sufficient ability to fix a transferred pattern is not formed on the transferred pattern. On the other hand, when the resin concentration is in excess of 7%, the resulting transfer solution is too tacky to function as a removing solution and has the possibility of precipitating the resin therein.

When the transfer solution composition of the present invention is applied onto the skin, antihistaminic agents such as diphenhydramine, chlorophenylamine, promethazine, meclizine and hydroxydine as a skin chapping inhibitor are preferably added in quantities of 0.1 to 0.6% to the composition. In the case where the skin chapping inhibitor added is less than 0.1%, substantial effectiveness cannot be obtained.

On the other hand, an addition quantity exceeding 0.6% not only is uneconomical but also harms the spraying property of the resulting composition when the composition is used as a spray type.

Other conventional additives such as an essential oil and perfumed oil coloring agents may be suitably added to the composition.

The respective constituents as described above are mixed together under heating and/or stirring, as required, to prepare a transfer solution.

The transfer solution may be applied in a liquid state onto the receiving surface by any method such as brushing. However, when the transfer solution is applied onto a transferred pattern as a protecting solution or directly onto the pattern layer of the transfer sheet as a transfer solution, the use of a brushing method may cause running of the transferred pattern. In such case, the spraying method may be advantageous. For this purpose, it is very convenient to charge into a pressure cylinder the above-described transferring solution to which a spraying agent such as freon has been previously added thereby to provide a spray type composition. (The term "spray type" as used herein designates a state of the solution wherein it can be atomized by releasing pressure through a nozzle.) This is because the transfer solution composition of the present invention may be used as a transfer solution or removing solution without any inconvenience even if it is of spray type.

The quantity of the spraying agent used is not essentially different from that used in conventional spraying methods, but the spraying agent is conveniently used in quantitites of about 200 to 240 parts by weight per 100 parts by weight of the above described liquid composition. A spraying pressure of about 2.5 atm was found to be suitable to ensure fine dividing of sprayed particles into the form of mist, and prevent flowing of a transferred pattern due to excessive pressure. The distance of the spray nozzle from the receiving object to be sprayed is, for example, about 5 cm for transfer and removal, and as long as about 30 cm for the formation of a protecting film. In the case of the latter, it is desirable to reduce the quantity to be sprayed in order to prevent the transferred pattern from flowing. Even if a protecting film is not always uniformly formed, the film functions effectively.

As mentioned above, the transfer sheet of the present invention is particularly suitable for use as a kit in conjunction with a transfer solution having the above specified composition.

It will be apparent from the foregoing that the transfer process of the present invention makes it possible to transfer exquisite, tattoo-like ornamental patterns onto the skin harmlessly, rapidly and easily. Since the transferred pattern on the skin obtained by the transfer process of the present invention is not dissolved out in sea water, water, warm water and sweat in bathing places, swimming pools, and bathrooms of hotels, the transfer process of the present invention can be enjoyed in various forms depending on various places and purposes. Because the resulting transferred pattern is highly resistant to greasy sweat and rubbing, no remarkable fading is observed even several days after the application.

In addition, since the transfer process of the present invention permits instant tatooing in accordance with its use in television and motion picture studios, it is unnecessary for artist or an expert in the field concerned to draw pictures, and it is possible to select freely various existing patterns of the tatoos from ancient times or to reproduce easily new patterns. Moreover, the same pattern can be applied and then removed several tens of times or even more times in a simple and accurate manner for picture taking at different times.

In addition to a tattoo-like transfer onto the skin in a bathing place in the summer season as described above, fixing an individual and colorful pattern on the fingers, hands and legs of a woman can be carried out most simply and cheaply by the transfer process of the present invention.

As another application utilizing the fact that the transfer process of the present invention is applicable to the skin, the present transfer process can be used in a preliminary practice for a make-up method for hiding a birthmark or a scar which is known as the Cover mark (trademark) and has been developed by Lydia O'Leary Inc. That is, various types of cover mark creams (cosmetics) for use in hiding birthmarks and scars are commercially available as an original color. However, the single application of these creams cannot cover various birthmarks and scars while matching them to the individual color of the skin. Accordingly, mixing of various original colors is resorted to in order to match the personality of the individual. However, this method requires skill. Therefore, in order to promote the sale of the cover mark cream, cream makers ordinarily hold lecture classes in meeting places of the various areas or the shop-fronts of cosmetics retail shops to provide guidance for using the cover mark cream. In these classes, a person actually possessing a birthmark and a scar is utilized as a model before observers and participants. Such classes are disadvantageous in that it is difficult to practice because of the sense of shame of the models, embarrassment of the observers, problems of ethics, and low appeal effectiveness.

The transfer sheet of the present invention can be provided with several tens to several hundreds of color changes by adjusting the colors of the inks. Accordingly, by using such a transfer sheet, it is possible to carry out the cover-mark experiments easily and economically on a large indefinite number of people while repeating the transfer-elimination cycle individually and freely by using their own arms or palms of the hands.

In the above description, the utilization of the transfer process of the present invention has been mainly illustrated in conjunction with application to the skin. However, the transfer process of the present invention is applicable to all receiving surfaces to which the above described dye inks can adhere. Examples of such application are surfaces of fibers, woods, metals and plastic products. Thus, the transfer process of the present invention can be utilized widely as a transfer process free of the limitations imposed by the use of heat or sublimable dyes which are encountered in the prior heat sublimation transfer process. Further, the advantage that the present transfer process is simple to practice is highly significant for such wide utilization.

The present invention will be illustrated in more detail by the following examples.

EXAMPLE 1

By using inks of three colors of a red dye, Rhodamine B Stearate; a yellow dye, Quinoline Yellow SS; and a blue dye, Sudan Blue B, a pattern layer having a thickness of the order of 10 to 50 microns was formed on the surface of a parchment paper (basis weight of 52 g per $m^2$, manufactured by Nippon Parchment Paper Company) by a silk screen printing method. The resulting composite was dried to obtain a pseudo-tattoo transfer sheet. The above mentioned inks contained 12% of the red dye and 18% of each of the blue dye and the yellow dye, and 21% of ethyl cellulose, 9% of citric acid esters and 70% of a solvent (containing Solvent No. 100 in addition to xylene) on the assumption that the constituents other than the dyes total 100.

With the transfer sheet thus obtained, transfer was carried out as follows. Ethyl alcohol was first applied onto the pertinent portions of the skin with absorbent cotton impregnated with ethyl alcohol. Then the transfer sheet was stuck on these portions in such a manner that the surface of the pattern layer of the sheet was superposed thereon, and the transfer sheet was lightly pressed against the skin. When the alcohol was partially dried to some degree, the sheet was peeled off from the skin. As a result, only the dyes were transferred onto the skin.

The resultant pattern was not distinguishable at all from a genuine tattoo at first sight. Further, when the transferred pattern was wiped with the above-mentioned cotton impregnated with ethyl alcohol, the pseudo-tattoo pattern would be easily removed.

EXAMPLE 2

A transfer sheet was produced by using a blotting paper (basis weight of 120 g/$m^2$, manufactured by Inoue Paper Manufacturing Company) in the same manner as in Example 1. When transfer was carried out with the sheet thus obtained, there was obtained a transferred pattern which was free of any running of the pattern layer and was excellent.

EXAMPLE 3

| | |
|---|---|
| (A transfer solution composition A) | |
| Geraniol-denatured alcohol | 94.45% |
| Polyvinyl butyral resin | |
| (Eslec BL-1) | 5.00% |
| Diphenhydramine | 0.20% |
| Perfume | 0.35% |

According to the above composition, the alcohol was first weighed and introduced into a vessel equipped with a stirrer, and the alcohol in the vessel was heated to a temperature of about 50° C. under stirring. Then the predetermined quantity of the resin was precisely weighed and added in small portions to the vessel to dissolve the same. After cooling, the perfume and diphenhydramine were added to the resultant mixture to produce a transfer solution composition of the present invention.

It was confirmed that the composition functioned as a transfer solution, a protecting solution and a resin film removing solution as described herein.

Similar results were obtained when compositions according to the following recipe were substituted for the above-described composition:

| | |
|---|---|
| (Composition B) | |
| Ethyl alcohol | 94.44% |
| Polyvinyl acetal resin | 5.00% |
| Diphenhydramine | 0.21% |
| Perfume | 0.35% |
| (Composition C) | |
| Ethyl alcohol | 94.48% |
| Polyvinyl acetal resin | 4.97% |
| Diphenhydramine | 0.22% |
| Perfume | 0.33% |

I claim:

1. A transfer process for transferring an image to a surface of living human skin comprising the steps of:

a. providing a transfer sheet comprising a substrate and a pattern layer containing lower-alcohol-soluble, water-insoluble dyes and provided on at least one surface of the substrate wherein said dyes are oil dyes which can be admixed in medicines and cosmetics;

b. wetting and contacting the pattern layer of the transfer sheet with a transfer solution containing lower alcohols and with the skin surface onto which the pattern is to be transferred in such a manner that the pattern layer contacts the skin surface;

c. maintaining the transfer sheet in close contact with the skin surface under pressure; and d. peeling the transfer sheet from the skin surface thereby to leave a transferred pattern corresponding to the pattern of the transfer sheet on the surface of the living human skin.

2. A transfer process as claimed in claim 1 wherein in the step b, after the pattern layer of the transfer sheet has first been wetted with the transfer solution, then the transfer sheet is brought into close contact with the skin surface in such a manner that the wetted pattern layer contacts the skin surface.

3. A transfer process as claimed in claim 1 wherein in the step b, wetting of the pattern layer and the close contacting between the transfer sheet and the skin surface are carried out by first applying the transfer solution onto the skin surface to be transferred and then bringing the transfer sheet into close contact with the thus applied skin surface in such a manner that the pattern layer of the transfer sheet contacts the skin surface.

4. A transfer process as claimed in claim 1, wherein in the step c, the pressure is of the order of the contact pressure applicable by a hand or fingers.

5. A transfer process as claimed in claim 1, wherein the substrate of the transfer sheet is a paper.

6. A transfer process as claimed in claim 1, wherein the substrate of the transfer sheet is a parchment paper.

7. A transfer process as claimed in claim 1, wherein the substrate of the transfer sheet is a blotting paper.

8. A transfer process as claimed in claim 1, wherein the pattern layer of the transfer sheet consists essentially of 30 to 40 parts of oil dyes, 45 to 55 parts of binders and 10 to 20 parts of plasticizers, all parts being by weight.

9. A transfer process as claimed in claim 1, wherein the lower alcohol is ethyl alcohol.

* * * * *